US007111358B1

(12) United States Patent
Jackson

(10) Patent No.: US 7,111,358 B1
(45) Date of Patent: Sep. 26, 2006

(54) TENSIONED PIVOT ASSEMBLY

(75) Inventor: B. Stewart Jackson, Spartanburg, SC (US)

(73) Assignee: Bommer Industries, Inc., Landrum, SC (US)

( * ) Notice: Subject to any disclaimer, the term of this patent is extended or adjusted under 35 U.S.C. 154(b) by 23 days.

(21) Appl. No.: 11/033,519

(22) Filed: Jan. 11, 2005

(51) Int. Cl.
*E05F 1/08* (2006.01)

(52) U.S. Cl. ..... 16/50; 16/76

(58) Field of Classification Search ..... 16/50, 16/301, 298–300, 235, 238, 256, 277, 280, 16/357, 363, 374, DIG. 10, DIG. 29, 70, 16/76, 72

See application file for complete search history.

(56) References Cited

U.S. PATENT DOCUMENTS

| | | | | | |
|---|---|---|---|---|---|
| 258,510 | A | | 5/1882 | Van Wagoner | 16/300 |
| 291,169 | A | | 1/1884 | Duncan | 16/300 |
| 317,410 | A | | 5/1885 | Niles | 16/300 |
| 688,857 | A | | 12/1901 | Locke | 16/300 |
| 870,640 | A | | 11/1907 | Ocumpaugh | 16/300 |
| 1,085,087 | A | | 1/1914 | King | 16/300 |
| 1,691,697 | A | | 11/1928 | Bommer | |
| 3,825,973 | A | * | 7/1974 | Gwozdz | 16/300 |
| 3,965,533 | A | * | 6/1976 | Frohlich | 16/300 |
| 4,043,001 | A | * | 8/1977 | Parsons | 16/222 |
| 4,141,123 | A | * | 2/1979 | Newlon | 29/11 |
| 4,419,788 | A | * | 12/1983 | Prout | 16/300 |
| 4,756,051 | A | * | 7/1988 | Shy | 16/50 |
| 5,031,270 | A | * | 7/1991 | Lee | 16/50 |
| 5,048,155 | A | * | 9/1991 | Hwang | 16/301 |
| 5,152,029 | A | * | 10/1992 | Pai | 16/54 |
| 5,572,768 | A | * | 11/1996 | Daul | 16/49 |
| 6,256,839 | B1 | * | 7/2001 | Wu | 16/366 |
| 6,618,902 | B1 | * | 9/2003 | Wu | 16/298 |
| 6,725,503 | B1 | * | 4/2004 | Lin | 16/76 |

* cited by examiner

*Primary Examiner*—Robert J. Sandy
*Assistant Examiner*—Andre' L. Jackson
(74) *Attorney, Agent, or Firm*—J.M. Robertson Intellectual Prop. LLC

(57) ABSTRACT

A spring biased pivot assembly for operative connection across a lower edge of a self-returning door structure. An adjustable spacer projects outwardly from a downwardly extending shoulder structure and towards a tension pin in tangential relation to the axis of rotation. The spacer contacts the tension pin when the door structure is in its normal position thereby maintaining separation between the tension pin and the shoulder structure and blocking complete release of spring tension.

2 Claims, 4 Drawing Sheets

TENSIONED PIVOT ASSEMBLY

TECHNICAL FIELD

This invention relates generally to a pivot assembly and more particularly to a spring biased pivot assembly for a self closing door, gate or the like. The pivot incorporates a cooperating tensioning collar engaging one end of a helical spring with a bottom cover member surrounding the tensioning collar. The tensioning collar holds a radially extending pin that engages a protruding set screw projecting outwardly from an exposed shoulder on the bottom cover to maintain tension on the spring when the pivot returns to a closed position. The maintenance of tension on the spring even on upon full release facilitates return of the attached door or gate to a defined position on a consistent basis.

BACKGROUND OF THE INVENTION

The spring biased pivots for use on self-closing door structures such as on food service counter gates, bathroom stall doors and the like are well known. One such spring biased pivot assembly has been marketed by a number of years by Bommer Industries, Inc. having a place of business in Landrum S.C. Such pivot assemblies operate by translating the movement of the door structure to axial rotation of a cover operatively connected to one end of a helical spring relative to an elongated spindle element operatively connected to an opposing end of the helical spring. The relative rotation tightens the spring as the door structure is displaced from its initial position. The biasing force by the spring causes the door structure to swing back to its initial starting position when the force causing the initial displacement is removed. By way of example, in a typical environment of use such as in a food service counter the user may open a gate by pushing or pulling on the gate thereby causing displacement from its original position. This displacement, in turn, is translated to a cover portion of the attached pivot thereby tightening a spring housed within the structure. When the user releases the gate, the displacement force is eliminated and the spring attempts to release the stored energy thereby imparting a recuperating biasing force to the displaced gate. As the tension within the spring is released, the gate swings back towards its starting position.

One recurring problem that has been encountered during the manufacture and use of prior spring biased pivot structures has been in achieving a consistent return of the gate or door being acted upon to the desired starting position. In particular, in order to assemble a spring biased pivot, a certain degree of tolerance is required between the interacting components. In the absence of applied tension to the spring, after assembly these elements may move slightly relative to one another when the door structure is not being acted upon. This slack or play between the components may allow the door structure to engage in a degree of drift away from the desired starting position. While such drift may be relatively slight at the side of the door structure adjacent the pivot, such rotational movement is magnified at the free end of the door structure which may be several feet away. Thus a drift at the pivot of even a few degrees may cause a relatively substantial displacement of the supported door structure. Moreover, over time the spring tension may be slightly reduced such that the return force is diminished thereby imparting additional inconsistency to the return performance.

In order to address the issue of consistent return of the supported door structure to a fixed defined position, a system has been utilized to maintain the biasing spring in constant tension by blocking axial rotation of the covering elements prior to complete spring recovery as the door structure is returning to its fixed position. This blocking has been carried out by using a bottom cover having a downwardly projecting blocking shoulder that engages a static pin inserted into a radial opening in the spring engaging tensioning collar. While such a system works and has been utilized for many years, substantial skill is required to achieve the required alignment of components such that the appropriate biasing force is preloaded upon initial assembly. However, even when the initial assembly is satisfactory, during use the change in spring character may still give rise to an undesirable degree of drift. In this event there is no usable mechanism to re-tension the biasing spring.

SUMMARY OF THE INVENTION

The present invention provides advantages and alternatives over the prior art by providing a spring pivot for a door structure incorporating a bottom covering having a downwardly projecting shoulder stop member. The shoulder stop member supports a set screw projecting outwardly from a side of the shoulder stop member tangential to the axis of rotation so as to engage a radially projecting static tension pin projecting outwardly from the tension collar engaging the spring when the door structure is in its normal position. Thus, the set screw defines an adjustable stop surface for engagement with a tension pin. The extension of the set screw thereby increases the biasing tension of the spring and maintains the spring in a state of continuous tension that is easily adjustable after assembly.

BRIEF DESCRIPTION OF THE DRAWINGS

The present invention will hereinafter be described by way of example only, with reference to the accompanying drawings which are incorporated in and which constitute a part of this specification herein and together with the general description of the invention given above, and the detailed description set forth below, serve to explain the principles of the invention wherein.

While the invention has been illustrated and generally described above and will herein after be described in connection with certain potentially preferred embodiments and practices, it is to be understood that in no event is the invention limited to such illustrated and described embodiments and practices. On the contrary it is intended that the present invention shall extend to all alternatives and modifications as may embrace the general principles of this invention within the full and true spirit and scope thereof.

DETAILED DESCRIPTION

Figure 1:
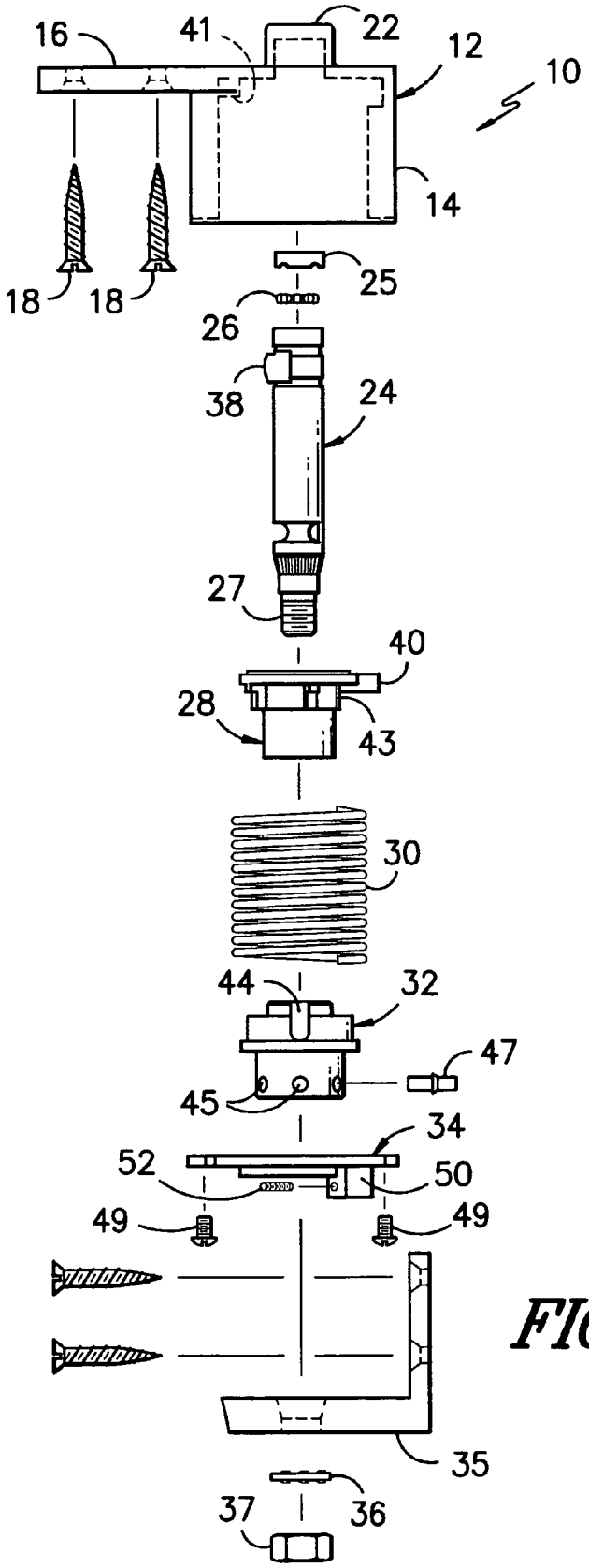
FIG. 1 is an exploded view illustrating an exemplary embodiment of a spring pivot assembly according to the present invention.
Figure 2:
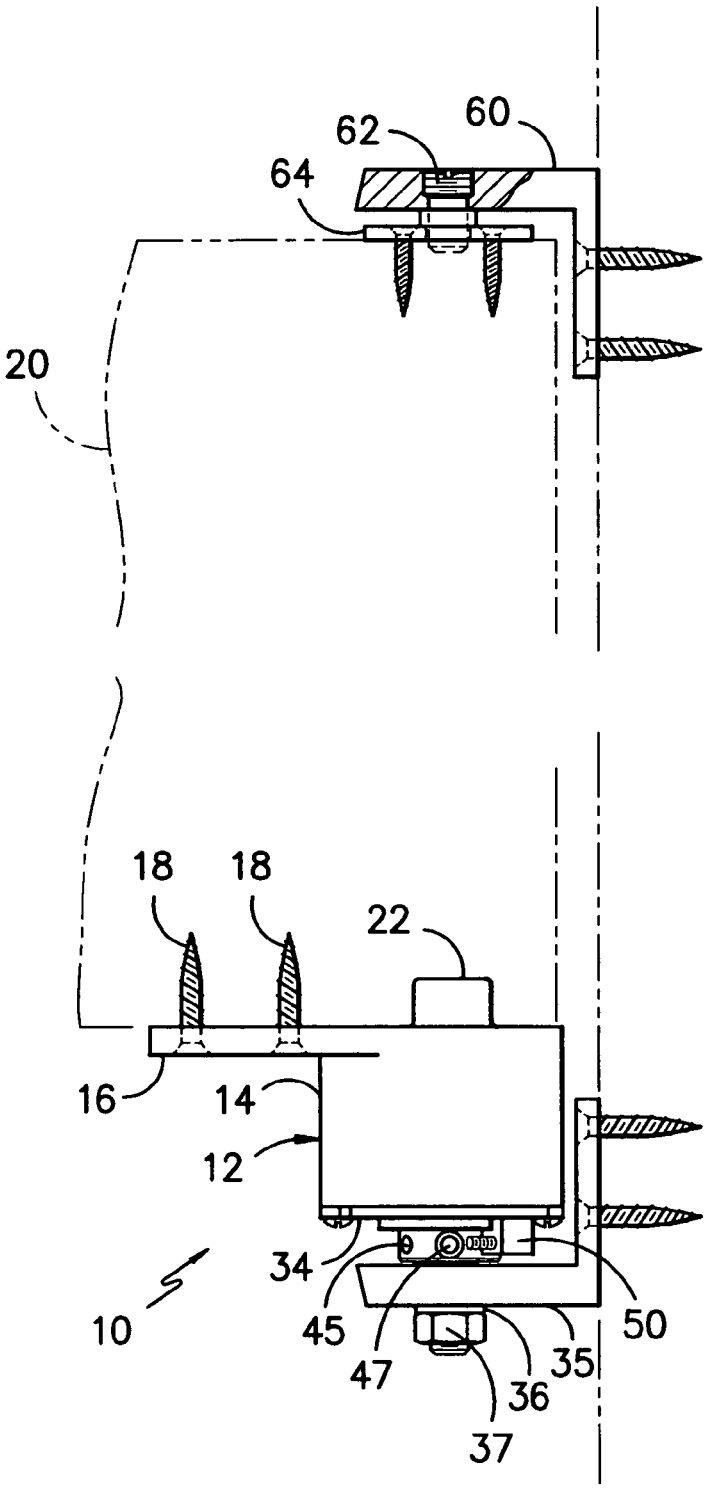
FIG. 2 is a partially cut-away view of the pivot assembly FIG. 1 in an installed operative position relative to door structure and supporting wall shown in phantom.

Turning now to the drawings, in FIG. 1 there is illustrated an exploded view of a spring pivot in accordance with the present invention. Looking simultaneously to FIGS. 1–3 it may be seen in this embodiment the spring pivot assembly 10 includes an over cover 12 preferably of a single piece cast structure. The over cover 12 preferably includes a body portion 14 defining an open bottomed cylinder for acceptance of interior operative components and a connective flange 16 having openings for the acceptance of screws 18 or other attachment structures to the base of a door structure 20. In this regard it is to be understood that by the term "door structure" is meant any door, gate or other similar closing structure for which string biased pivots are suitable.

As illustrated, in one potentially preferred construction the over cover 12 includes a reduced diameter hollow nipple portion 22 for acceptance and retension of an upper portion of an axially aligned spindle 24. In the illustrated construction, a bearing race 25 supporting an arrangement of ball bearings 26 is housed at the interior of the nipple 22 so as to reduce frictional wear between the over cover 12 and the top of the spindle 24. As shown, the spindle 24 has an elongate body terminating at a threaded distal portion 27. The spindle 24 projects through the hollow interiors of an upper collar 28, a helical spring 30, a tensioning collar 32 and a bottom cover 34. As illustrated the threaded distal portion of the spindle portion 27 of the spindle 24 may thereafter be passed through an opening within a supporting wall bracket 35 so that it may be held in place in supported relation by a lock washer 36 and cooperating nut 37 as shown.

As illustrated, the spindle 24 is substantially cylindrical in shape but includes a radially projecting detent 38 that prevents passage through the upper collar 28. The upper collar 28 includes an outwardly projecting detent member 40 that cooperatively engages in an inwardly projecting member 41 projecting inwardly from the wall of the over cover 12. Thus, as the door structure 20 is rotated such as by a pushing or pulling force applied by a user the over cover 12 and upper collar 28 undergo a corresponding angular rotational displacement moving around the spindle 24. The spindle 24 is held stationary by the lock washer 36 and cooperating nut 37.

Figure 3:
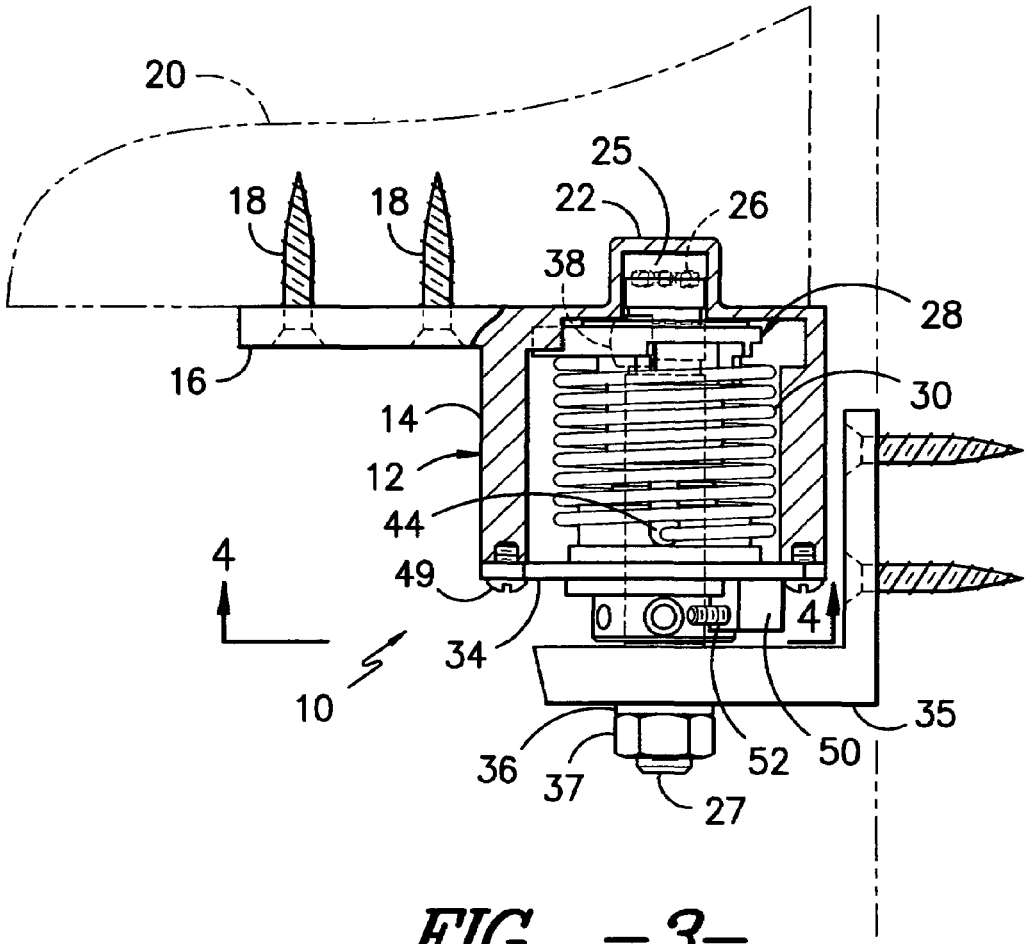
FIG. 3 is a cut-away view of the pivot assembly FIG. 1 in an installed position relative to a door and supporting wall structure shown in phantom.
Figure 4:
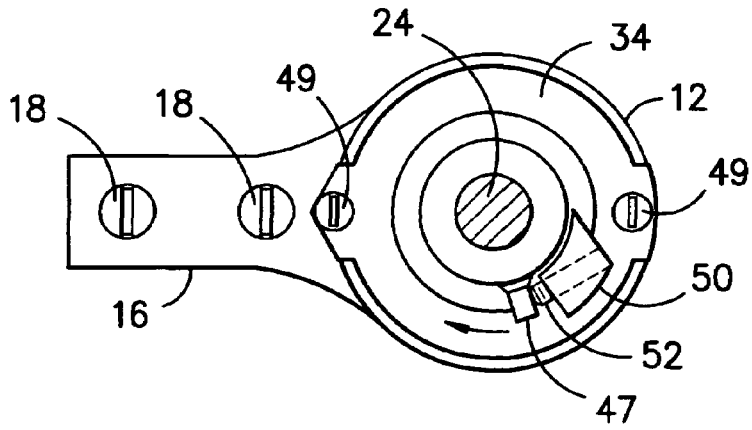
FIG. 4 is a view taken generally along line 4—4 in FIG. 3 and illustrating the bottom cover of the pivot assembly with the spring tensioning set screw engaging a radially projecting tension pin.
Figure 5:
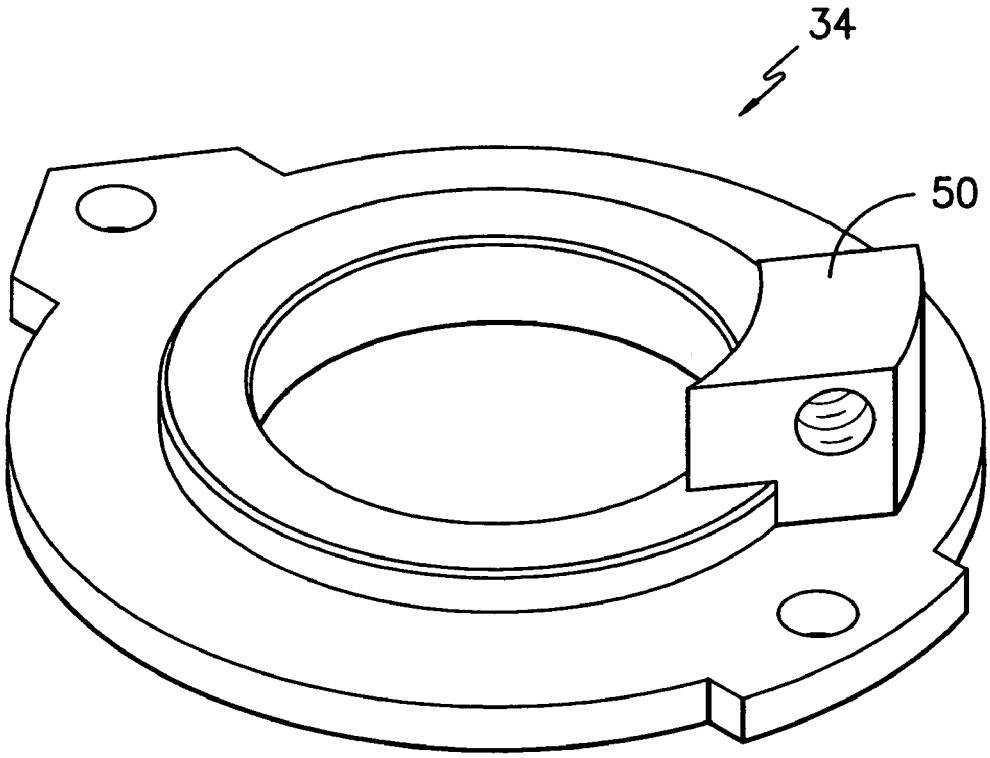
FIG. 5 is an elevation perspective view of a bottom covering for a pivot assembly incorporating an outwardly projecting shoulder stop tapped for acceptance of an adjustable setscrew.

The bottom portion of the upper collar 28 is sized to slide into the center opening of the helical spring 30. However, the upper portion of the upper collar 28 has a diameter greater than the center opening of the helical spring and is thereby caused to rest on top of the helical spring, At the top of the helical spring coil the spring wire turns approximately 90° so as to form a short tail projecting towards the center of the coil. In the preferred construction this tail slides into a cooperating vertical groove 43 on the upper collar 28 so that rotational movement of the upper collar 28 results in a tightening of the helical spring 30. As best illustrated in FIG. 3, an inwardly projecting tail at the bottom of the helical spring 30 fits into a vertical groove 44 in the tensioning collar 32. After assembly the tensioning collar remains substantially static so as to provide a stable base for the spring 30 as it is tightened by rotation of the upper collar 28.

As illustrated, the tensioning collar 32 includes an arrangement of radially extending openings 45 sized to accept one end of a tension pin 47 after the lower portion of the tensioning collar 32 is inserted through the opening in the bottom cover 34. As can be seen by rotating the tensioning collar 32 while holding the over cover 12, upper collar 28 and spindle 24 fixed, the helical spring 30 may be preloaded with tension during the assembly process. Insertion of the tension pin 47 locks in and maintains this preloaded tension.

According to the construction of the present invention the bottom cover 34 is secured in fixed relation to the over cover 12 by screws or other attachment structures 49. Thus, the angular rotation of the door structure 20 is likewise translated to the bottom cover 34. The bottom cover 34 includes a downwardly projecting shoulder structure 50 housing a set screw 52 projecting tangentially to the axis of rotation around the spindle 24. As shown, upon extension the set screw engages an outwardly projecting portion of the preplaced tension pin 47 thereby acting as a spacer between the shoulder structure 50 and the tension pin 47. As the set screw 52 is extended, the shoulder structure 50 is pushed away from the tension pin 47 thereby causing a slight angular rotation of the over cover 12 and upper collar 28. This rotation causes additional tension to be preloaded into the spring. Of course it is also contemplated that spacers other than set screws may be used if desired. By way of example only, such spacers may include threaded caps that screw out from a fixed position screw and the like if desired.

In operation, the door structure 20 is normally supported from below by the flange 16 with the pivot 10 supported on the bracket 35 attached to a supporting wall or door jam. The door structure 20 is preferably supported along an upper edge by a second bracket 60 housing a static pin structure 62 axially supported within a plate 64 secured along an upper edge of the door structure such that the door rotates freely around the static pin structure 62 in a manner that will be well known to those of skill in the art. Of course, any other supporting arrangement that permits door rotation can likewise be utilized if desired. When the door structure 20 is rotated, this rotation is translated to the over cover 12 and the upper collar 28. These elements rotate around the spindle 24 while the spindle 24 and tensioning collar 28 remain stationary. This relative rotation causes the shoulder structure 50 to move away from the tension pin 47 as the outer cover 12 is rotated. This relative movement further tightens the helical spring 30. When the door structure 20 is released, the helical spring 36 seeks to eliminate the internal stresses and the elements rotate back to their initial condition. However, due to the tension imparted by the set screw that maintains a distance between the shoulder structure 50 and the tension pin 47, the helical spring is prevented from relieving its tension entirely. Thus, the door structure 20 is constantly being biased toward the starting position. The door structure 20 thus returns to a consistent condition and does not drift. Moreover, as the spring loosens over time preloaded tension can be replaced by simply extending the set screw 52.

As will be appreciated, while the present invention has been illustrated and described in relation to various potentially preferred embodiments, constructions, and procedures, such embodiments, constructions, and procedures are illustrative only and the present invention is in no event to be limited thereto. Rather, it is contemplated that modifications and variations embodying the principles of this invention will no doubt occur to those of skill in the art. Accordingly, it is contemplated and intended that the present invention will extend to all such modifications and variations as may incorporate the broad principles of the invention within the full spirit and scope thereof.

The invention claimed is:

1. A spring biased pivot assembly for operative connection across a lower edge of a self-returning door structure, the pivot assembly comprising: a helical torsion spring held between a first collar member and a second collar member, wherein the first collar member is disposed within an over cover structure adapted to be operatively connected to the lower edge of the door structure, and wherein the second collar member includes a reduced diameter portion adapted to project through a bottom cover, wherein the bottom cover is attached in fixed relation to the over cover structure such that the bottom cover and over cover rotate around a common axis of rotation when the door structure is displaced, the reduced diameter portion of the second collar member having a plurality of radially disposed openings adapted to accept one end of a tension pin such that said one end of the tension pin extends through one of said openings and into engagement with a spindle extending axially through the interior of the second collar with an opposing end of the tension pin projecting outwardly from said reduced diameter portion at a position below the bottom cover, and wherein the bottom cover includes a downwardly depending shoulder structure disposed adjacent to the tension pin; wherein the improvement comprises, an adjustable set screw projecting outwardly from the shoulder structure and towards the outwardly projecting end of the tension pin in tangential relation to the axis of rotation such that the set screw contacts the tension pin when the door structure is in its normal position thereby maintaining separation between the tension pin and the shoulder structure and blocking complete release of spring tension.

2. A spring biased pivot assembly for operative connection across a lower edge of a self-returning door structure, the pivot assembly comprising: a helical torsion spring held between a first collar member and a second collar member, wherein the first collar member is disposed within an over cover structure adapted to be operatively connected to the lower edge of the door structure, and wherein the second collar member includes a reduced diameter portion adapted to project through a bottom cover, wherein the bottom cover is attached in fixed relation to the over cover structure such that the bottom cover and over cover rotate around a common axis of rotation when the door structure is displaced, the reduced diameter portion of the second collar member having a plurality of radially disposed openings adapted to accept one end of a tension pin such that said one end of the tension pin extends through one of said openings and into engagement with a spindle extending axially through the interior of the second collar with an opposing end of the tension pin projecting outwardly from said reduced diameter portion at a position below the bottom cover, and wherein the bottom cover includes a downwardly depending shoulder structure disposed adjacent to the tension pin; wherein the improvement comprises, an adjustable spacer element projecting outwardly from the shoulder structure and towards the outwardly projecting end of the tension pin in tangential relation to the axis of rotation such that the spacer element contacts the tension pin when the door structure is in its normal position thereby maintaining separation between the tension pin and the shoulder structure and blocking complete release of spring tension.

* * * * *